US009643033B2

(12) United States Patent
Yadav et al.

(10) Patent No.: US 9,643,033 B2
(45) **Date of Patent: *May 9, 2017**

(54) DISPOSABLE SAFETY GARMENT WITH IMPROVED NECK CLOSURE

(71) Applicant: Quest Environmental & Safety Products, Inc., Fishers, IN (US)

(72) Inventors: Sudhansu S. Yadav, Carmel, IN (US); Mark Dieterle, Noblesville, IN (US); Joseph T. Marcum, Indianapolis, IN (US); Elliott Thompson, Noblesville, IN (US)

(73) Assignee: QUEST ENVIRONMENTAL & SAFETY PRODUCTS, INC., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/010,247

(22) Filed: Jan. 29, 2016

(65) Prior Publication Data

US 2016/0151648 A1 Jun. 2, 2016

Related U.S. Application Data

(63) Continuation-in-part of application No. 14/108,766, filed on Dec. 17, 2013, now Pat. No. 9,248,322, (Continued)

(51) Int. Cl.
*A41D 27/24* (2006.01)
*A41D 13/02* (2006.01)
(Continued)

(52) U.S. Cl.
CPC ..... *A62B 17/006* (2013.01); *G21F 3/025* (2013.01); *A41D 13/0012* (2013.01); (Continued)

(58) Field of Classification Search
CPC ..... A41D 13/1209; A41D 13/02; A41D 2400/44; A41D 13/1218; A41D 2500/30; (Continued)

(56) References Cited

U.S. PATENT DOCUMENTS 2,668,294 A 2/1954 Gilpin
3,179,955 A 4/1965 Worth
(Continued)

FOREIGN PATENT DOCUMENTS

JP 2000317165 11/2000
JP 2006002311 1/2006
WO 0122842 4/2001

OTHER PUBLICATIONS

U.S. Appl. No. 60/955,718, filed Aug. 14, 2007, Marcum, et al.
(Continued)

*Primary Examiner* — Bobby Muromoto, Jr.
(74) *Attorney, Agent, or Firm* — Daniel L. Boots; Brian W. Chellgren; Bingham Greenebaum Doll LLP

(57) ABSTRACT

Nonwoven safety garments include, in some embodiments, features of the stitching which limit the number of particulates emitted from seams between cut edges. Attachments features may be included on the garments to enable secure, external attachment of measuring equipment. Doffing features, such as loops, are provided to help the wearer safely remove the garment, either by helping her pull off part or all of the garment or by starting to separate closure devices, while avoiding contact between the wearer's hands and head, neck or body. In some embodiments, a re-positionable elastic closure on a neck flap covers the neck up to the bottom of a face mask or respirator, and a grasping tab helps the wearer safely open the re-positionable closure and the (Continued)

neck flap without contacting his or her neck or the interior of the garment, thereby avoiding a personal contamination event.

20 Claims, 10 Drawing Sheets

Related U.S. Application Data which is a continuation of application No. 13/243,282, filed on Sep. 23, 2011, now Pat. No. 8,621,669, which is a continuation-in-part of application No. 12/192,097, filed on Aug. 14, 2008, now abandoned, which is a continuation-in-part of application No. 11/428,728, filed on Jul. 5, 2006, now abandoned, which is a continuation-in-part of application No. 10/798,646, filed on Mar. 11, 2004, now abandoned.

(60) Provisional application No. 60/955,718, filed on Aug. 14, 2007.

(51) Int. Cl.
*A62B 17/00* (2006.01)
*G21F 3/025* (2006.01)
*A41D 13/00* (2006.01)

(52) U.S. Cl.
CPC ..... *A41D 13/02* (2013.01); *A41D 2400/52* (2013.01); *A41D 2500/30* (2013.01); *G21Y 2002/201* (2013.01); *G21Y 2002/301* (2013.01); *G21Y 2002/304* (2013.01); *G21Y 2004/30* (2013.01)

(58) Field of Classification Search
CPC ..... A41D 2400/52; A41D 31/0011; A41D 13/1263; A41D 2300/32; A41D 13/1236; A41D 13/1245; A41D 13/0012; A41D 13/008; A41D 13/1254; A41D 19/0037; A41D 27/24; A41D 27/245; A41D 31/00; A62B 17/006; A62B 17/001; A62B 17/04; Y10S 2/901; Y10S 2/912; A62D 5/00
USPC ..... 2/1, 455, 456, 457, 46, 48, 51, 69, 69.5, 2/227, 275, 901
See application file for complete search history.

(56) References Cited

U.S. PATENT DOCUMENTS 3,381,440 A 5/1968 Hullhorst
3,382,643 A 5/1968 Hullhorst
3,486,470 A 12/1969 Florczak
3,499,261 A 3/1970 Hullhorst
3,773,200 A 11/1973 Morris
3,775,933 A 12/1973 Prescott et al.
3,776,372 A 12/1973 Lemelson
3,782,309 A 1/1974 Lee
3,798,874 A 3/1974 Lemelson
3,906,878 A 9/1975 Burton
3,949,130 A 4/1976 Sabee et al.
4,041,203 A 8/1977 Brock et al.
4,066,025 A 1/1978 Speer
4,106,120 A 8/1978 Zurbrigg et al.
4,272,851 A 6/1981 Goldstein
4,286,439 A 9/1981 Pasternack
4,324,087 A 4/1982 Mitchell et al.
4,408,438 A 10/1983 Rewitzer
4,448,138 A 5/1984 Freerman
4,491,079 A 1/1985 Gustavsson
4,512,464 A 4/1985 Sylvester
4,517,714 A 5/1985 Sneed et al.
4,525,407 A 6/1985 Ness
4,546,497 A 10/1985 Ono et al.
4,613,640 A 9/1986 Deisler et al.
4,624,200 A 11/1986 Fisher
4,648,336 A 3/1987 Ragnebring
4,655,760 A 4/1987 Morman et al.
4,670,073 A 6/1987 Langley
4,670,913 A 6/1987 Morell et al.
4,683,593 A 8/1987 Langley
4,688,566 A 8/1987 Boyce
4,689,831 A 9/1987 Greenberger et al.
4,753,182 A 6/1988 Blackburn
4,757,669 A 7/1988 Areblom et al.
4,818,597 A 4/1989 DaPonte et al.
4,848,222 A 7/1989 Fleissner
4,860,382 A 8/1989 Markwell
4,928,611 A 5/1990 Ogawa
4,932,078 A 6/1990 Jones et al.
4,938,817 A 7/1990 Langley
4,998,296 A 3/1991 Stames
5,003,902 A 4/1991 Benstock et al.
5,005,216 A 4/1991 Blackburn et al.
5,042,227 A 8/1991 Merry
5,119,515 A 6/1992 Altinger
5,150,660 A 9/1992 Kuczynski
5,165,353 A 11/1992 Freerman
5,172,629 A 12/1992 Merry
5,188,885 A 2/1993 Timmons et al.
5,229,181 A 7/1993 Daiber et al.
5,309,828 A 5/1994 Merry
5,417,912 A 5/1995 Merry
5,447,012 A 9/1995 Kovacs et al.
5,492,753 A 2/1996 Levy et al.
5,493,730 A 2/1996 Vo-Dinh
5,511,246 A 4/1996 Farkus et al.
5,524,531 A 6/1996 Merry
5,564,356 A 10/1996 Reinders
5,620,098 A 4/1997 Boos et al.
5,690,537 A 11/1997 Kalmus
5,692,606 A 12/1997 Elmaleh
5,784,717 A 7/1998 Singer
5,815,834 A 10/1998 Bronson
5,878,551 A 3/1999 Curley et al.
5,934,470 A 8/1999 Bauer et al.
5,991,921 A 11/1999 Saito
5,996,320 A 12/1999 Todd et al.
6,038,699 A 3/2000 Han et al.
6,047,413 A 4/2000 Welchel et al.
6,117,515 A 9/2000 Brunson et al.
6,235,660 B1 5/2001 Bhattacharjee et al.
6,378,136 B2 4/2002 Matsushita
6,435,116 B2 8/2002 Ribble et al.
6,854,135 B2 2/2005 Jones et al.
7,203,974 B2 4/2007 Jones et al.
7,651,653 B2 1/2010 Morman et al.
7,699,195 B2 4/2010 Scott
8,621,669 B2 * 1/2014 Yadav ..... G21F 3/025 2/227
9,248,322 B2 * 2/2016 Yadav ..... G21F 3/025
2001/0032346 A1 10/2001 Matsushita
2001/0034891 A1 11/2001 Matsushita
2001/0041487 A1 11/2001 Brady et al.
2002/0046549 A1 4/2002 O'Connor et al.
2002/0046550 A1 4/2002 O'Connor et al.
2002/0100107 A1 8/2002 Shin
2003/0166369 A1 9/2003 De Leon et al.
2003/0226196 A1 12/2003 Grilliot
2003/0229936 A1 12/2003 Tremblay-Lutter et al.
2004/0006815 A1 1/2004 Carroll
2004/0060649 A1 4/2004 Van Gompel et al.
2004/0107473 A1 6/2004 Jones et al.
2004/0118505 A1 6/2004 Shimakawa et al.
2005/0050608 A1 3/2005 Jones et al.
2005/0188907 A1 9/2005 D'Henin
2005/0198726 A1 9/2005 Yadav
2005/0198926 A1 9/2005 Yadav et al.
2006/0026731 A1 2/2006 Qashou
2006/0081489 A1 4/2006 Wheeler et al.
2006/0096003 A1 5/2006 Plaatje et al.

(56) References Cited

U.S. PATENT DOCUMENTS

| | | | |
|---|---|---|---|
| 2006/0117598 | A1 | 6/2006 | Czaplewski et al. |
| 2006/0131783 | A1 | 6/2006 | Morman et al. |
| 2006/0150305 | A1 | 7/2006 | Plut |
| 2009/0019616 | A1 | 1/2009 | Smith et al. |
| 2009/0126088 | A1 | 5/2009 | Yadav et al. |
| 2009/0173048 | A1 | 7/2009 | Yadav et al. |
| 2010/0257661 | A1 | 10/2010 | Yadav et al. |

OTHER PUBLICATIONS

U.S. Appl. No. 11/428,728, filed Jul. 5, 2006, Yadav, et al.
Application No. PCT/US2012/056627, International Preliminary Report on Patentability Apr. 3, 2014.
U.S. Appl. No. 10/798,646, Restriction Requirement May 9, 2005.
U.S. Appl. No. 10/798,646, Response to Restriction Requirement Jun. 13, 2005.
U.S. Appl. No. 10/798,646, Non-Final Office Action Aug. 25, 2005.
U.S. Appl. No. 10/798,646, Response to Non-Final Office Action Jan. 26, 2006.
U.S. Appl. No. 10/798,646, Response to Non-Final Office Action Feb. 17, 2006.
U.S. Appl. No. 10/798,646, Final Office Action Mar. 6, 2006.
U.S. Appl. No. 10/801,046, Non-Final Office Action Sep. 26, 2006.
U.S. Appl. No. 12/192,097, Non-Final Office Action Jan. 14, 2010.
U.S. Appl. No. 12/192,097, Response to Non-Final Office Action Apr. 14, 2010.
U.S. Appl. No. 12/192,097, Final Office Action Jun. 16, 2010.
U.S. Appl. No. 12/192,097, Response to Final Office Action Sep. 16, 2010.
U.S. Appl. No. 12/192,097, Advisory Action Nov. 19, 2010.
U.S. Appl. No. 12/192,097, Request for Continued Examination Dec. 9, 2010.
U.S. Appl. No. 12/192,097, Final Office Action Jan. 10, 2011.
U.S. Appl. No. 12/192,097, Notice of Restarted Response Period Feb. 2, 2011.
U.S. Appl. No. 12/192,097, Request for Continued Examination May 4, 2011.
U.S. Appl. No. 12/192,097, Non-Final Office Action May 23, 2011.
U.S. Appl. No. 12/192,097, Interview Summary—Examiner Initiated Dec. 5, 2011.
U.S. Appl. No. 11/428,728, Restriction Requirement Aug. 2, 2007.
U.S. Appl. No. 11/428,728, Response to Restriction Requirement Jan. 31, 2008.
U.S. Appl. No. 11/428,728, Non-Final Office Action Mar. 18, 2008.
U.S. Appl. No. 11/428,728, Response to Non-Final Office Action Sep. 18, 2008.
U.S. Appl. No. 11/428,728, Final Office Action Nov. 12, 2008.
U.S. Appl. No. 11/428,728, Examiner Interview Summary Feb. 5, 2009.
U.S. Appl. No. 12/422,842, Non-Final Rejection Nov. 18, 2010.
U.S. Appl. No. 12/422,842, Examiner Interview Summary May 17, 2011.
U.S. Appl. No. 12/406,708, Non-Final Rejection Dec. 10, 2010.
U.S. Appl. No. 12/406,708, Examiner Interview Summary May 9, 2011.
U.S. Appl. No. 12/406,708, Response to Non-Final Office Action May 10, 2011.
U.S. Appl. No. 12/406,708, Final Office Action Jul. 13, 2011.
U.S. Appl. No. 12/406,708, Notice of Appeal Oct. 13, 2011.
U.S. Appl. No. 12/406,708, Request for Pre-Appeal Conference Oct. 13, 2011.
U.S. Appl. No. 12/406,708, Appeals Conference Reopen Prosecution Feb. 1, 2012.
U.S. Appl. No. 12/406,708, Non-Final Office Action Mar. 7, 2012.
U.S. Appl. No. 12/406,708, Applicant Initiated Interview Summary Aug. 3, 2012.
U.S. Appl. No. 12/406,708, Response to Non-Final Office Action Sep. 7, 2012.
U.S. Appl. No. 12/406,708, Non-Final Office Action Nov. 23, 2012.
Application No. PCT/US2012/056627, International Search Report and Written Opinion Jan. 17, 2013.
U.S. Appl. No. 13/243,282, Non-Final Office Action Feb. 12, 2013.
U.S. Appl. No. 13/243,282, Applicant Initiated Interview Summary May 16, 2013.
U.S. Appl. No. 13/243,282, Response to Non-Final Office Action Jul. 12, 2013.
U.S. Appl. No. 13/243,282, Notice of Allowance Sep. 3, 2013.
U.S. Appl. No. 10/798,646, Non-Responsive Amendment Jan. 26, 2006.
Application No. 101798,646, Non-Responsive Amendment Feb. 14, 2006.
Application No. 101801,046, Office Action Sep. 26, 2006.

* cited by examiner

DISPOSABLE SAFETY GARMENT WITH IMPROVED NECK CLOSURE

REFERENCE TO RELATED APPLICATIONS

The present application is a continuation-in-part (CIP) of allowed U.S. patent application Ser. No. 14/108,766, filed Dec. 17, 2013, which is a continuation (CON) of U.S. patent application Ser. No. 13/243,282, filed Sep. 23, 2011 (now issued as U.S. Pat. No. 8,621,669), which is a continuation-in-part (CIP) of U.S. patent application Ser. No. 12/192,097, filed Aug. 14, 2008 (now abandoned), which is a nonprovisional of U.S. Provisional App. No. 60/955,718, filed Aug. 14, 2007, and was a continuation-in-part (CIP) of U.S. patent application Ser. No. 11/428,728, filed Jul. 5, 2006 (now abandoned), which was a continuation-in-part (CIP) of U.S. patent application Ser. No. 10/798,646, filed Mar. 11, 2004 (now abandoned), the entireties of which are all hereby incorporated herein by reference. Any disclaimer that may have occurred during the prosecution of any of the aforementioned applications is hereby expressly rescinded.

TECHNICAL FIELD

The present invention relates generally to the field of safety apparel, and more specifically to safety garments for use in various environments, including for example environments containing actual or potential radiological, biological, or light-splash hazards, the apparel having, in various embodiments, reduced particulate shedding properties, attachment facilities, reinforced points of wear or contact contamination risk, ease-of-safe-removal characteristics, and improved neck closures.

BACKGROUND

Safety garments, such as disposable smocks, jumpsuits, gloves, shoe coverings, and hair coverings, are required apparel for the performance of many jobs. Some of the jobs requiring such safety garments are performed in "clean room" environments, wherein the introduction of foreign matter must be minimized, if not eliminated. For example, technicians in certain sensitive medical fields dealing with infectious matter, aerospace researchers assembling interplanetary probes, and material scientists developing and manufacturing ultra-pure materials, all wear safety garments in such clean room environments.

The safety garments in certain situations perform the dual function of protecting the wearer from the potentially hazardous materials he or she is working with, as well as preventing unwanted matter from the wearer's person from contaminating his or her work product. In other situations, safety garments protect the worker from exposure to dangerous materials, such as radioactive, chemical and biological hazards.

Safety garments for such uses are typically constructed from nonwoven disposable materials, such as from sheets of spunbond/melt blown/melt blown/spunbond (SMMS) material and the like. Such sheets of material are cut into patterns and stitched together to form desired safety apparel. Typically, as these garments are intended to be disposable, and their focus being functionality and not aesthetic appeal, little attention is paid to the hemming and stitching of such garments, whereby the "as cut" edges are typically exposed. However, in clean room environments where contaminant levels in the parts per million, or even parts per billion, would be unacceptable, such exposed cut edges present genuine sources of potential particulate contamination.

Moreover, as these garments are intended to be disposable, little effort is made to provide durable stitching. The prevalent attitude is that a garment intended to be worn for just a few hours does not require superior stitching. However, in a clean room situation or a hazardous environment, such as asbestos remediation or nuclear demolition and decontamination, seam separation is not only a potential source of particulate evolution in and of itself, but also produces a dangerous pathway from the exterior to the interior of the garment, through which potentially hazardous material may flow.

In addition, many workplace environments, from industrial settings to hospitals, hold the potential to expose workers to various types of radiation. One problem faced by workers in such environments is how to safely perform tasks while monitoring their exposure to potentially harmful radiation. Often such protective measures include the use of personal radiation measuring devices, referred to as "dosimeters," along with protective garments.

Traditionally, personal dosimeters have been attached to a worker's protective garments using tape or some other improvised means. Under normal working conditions, such informal attachment methods often lead to the detachment and potential loss or damage to the dosimeter device. Additionally, such protective garments are often bulky and difficult to remove safely when they are no longer needed.

Further, while most protective apparel is used with full-faced respirators to safeguard against respiratory particulate or chemical vapor inhalation in environments where minor skin contamination is not a major health issue, but presents an inconvenience (e.g., spray painting), radiological and health care workers must maintain a contamination-free environment inside the protective "envelope" of their protective clothing and guard against contamination while doffing the protective clothing after the work in a contaminated zone is completed. Hence, they cannot overlook any types of gaps or openings in or to the safety garment.

Heretofore, the solution to bridging the gap typically formed by the closed zipper and hood underneath the chin and respirator has been, in an improvised manner, to apply layers of duct, vinyl, masking or other tapes over the gap and surrounding the respirator mask in an attempt to achieve a "tight" seal. This requires a separate safety professional to conduct audits (i.e. garment inspections) of personnel entering contamination areas to ensure adequate application of the tape and correct positioning. It also requires skillful and careful removal of the contaminated tape around the neck area upon exiting the contaminated work area while the personnel are still wearing potentially contaminated protective gloves, which further risks exposing the worker's neck to that cross-contamination, thereby creating a Personal Contamination Event (PCE) that may risk the worker's health and possibly have to be reported to a regulatory agency.

Traditional designs for this level of protective garment account for a large portion of accidental self-contamination or PCEs each year. Even if a front zipper is closed to the end of its travel path, and the hood is applied over the head and around the face, many of those designs leave a gap in the neck area below the chin. Often, tape is then wrapped around the respirator or other face mask to cover that gap as noted. When the person is wearing a respirator, this gap can easily allow contaminants against the skin, which in radiological or biological environments is considered a recordable accident by the Occupational Safety & Health Administration (OSHA). Safe removal of the apparel is also often challenging, sometimes requiring a partner or observer and/or a mirror to help the wearer find the end of the tape to begin the sequence of doffing the hood and respirator, which simply further runs the risk of self-contamination.

Thus, there remains a need for an improved safety garment that is more durable and less prone to particulate shedding. There is also a need for a protective garment to which personal dosimeter devices and other monitoring equipment can be effectively attached, as well as a garment that can be removed quickly, safely, and easily, and withstands high-wear regions such as elbows and knees. There is a further need for a garment that protects the wearer from radiological, biological, environmental, and other contaminants, both during exposure and during doffing of the garment. There is also a need for a hood-and-closure mechanism configured to close snugly about a respirator or supplied air mask. The present disclosure addresses these needs.

SUMMARY

One aspect of the present disclosure relates to a safety garment. Some embodiments include at least one sheet of nonwoven fabric having at least one cut edge, a plurality of stitches formed in the sheet(s) of nonwoven fabric to define a garment; and hemming formed at cut edges. The nonwoven fabric is preferably formed from spunbond/melt blown material. The stitching is characterized by an optimized stitch density of between eight and twelve stitches per inch. The garment includes at least one attachment feature for holding or attaching one or more dosimeters to the garment. These may be positioned to allow the wearer to grasp them and tear open certain seams, partially or completely open a zipper, or otherwise remove the garment. In various embodiments, the garment also includes an improved neck closure that simplifies donning of the garment and aids the wearer's effort to doff the suit while avoiding self-contamination events. Some embodiments have reinforced knees and elbows for additional protection against contact with hazardous materials.

One object of the present invention is to provide an improved disposable safety garment having a better-fitting neck closure. An object of some embodiments is to facilitate doffing of the garment with a reduced risk of contaminating oneself. Related objects and advantages of the present invention will be apparent from the following description.

DESCRIPTION OF THE PREFERRED EMBODIMENTS

Figure 1:
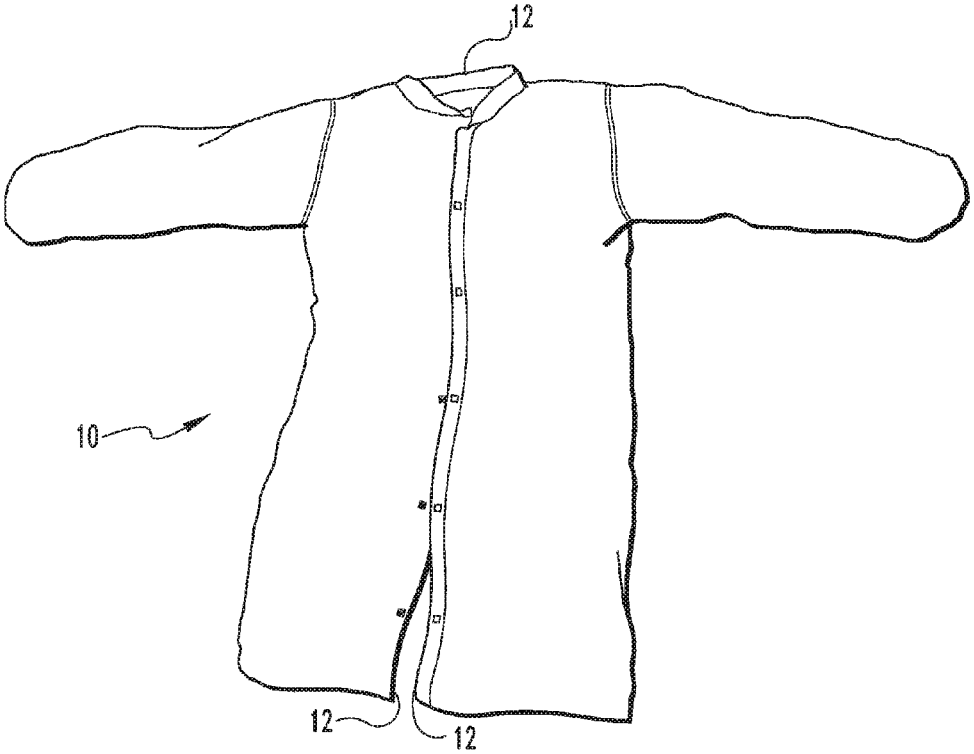
FIG. 1 is a perspective view of a safety garment in a first embodiment.

For the purposes of promoting an understanding of the principles of the disclosure and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated embodiments and such further applications of the principles of the invention as illustrated therein being contemplated as would normally occur to one skilled in the art.

Figure 2:
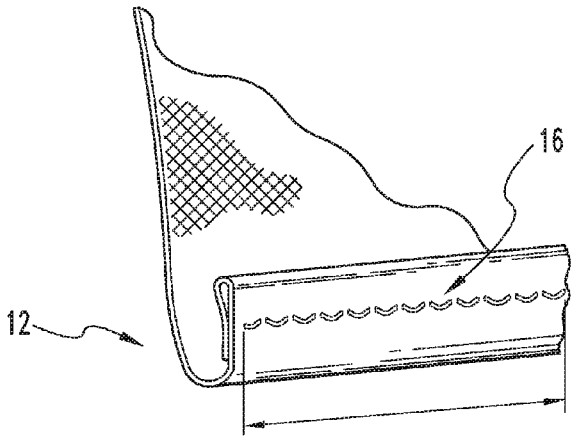
FIG. 2 is an enlarged exploded partial view of a hemmed edge of the embodiment of FIG. 1.

FIGS. 1 and 2 illustrate a first embodiment of the disclosed technology, a reduced particulate shedding disposable nonwoven safety garment 10. In this embodiment, safety garment 10 is formed as a smock. Safety garment 10 is preferably made from spunbond/melt blown/melt blown/spunbond (SMMS) material, spunbond/melt blown/spunbond (SMS) material, or the like, and includes double-folded and hemmed edges 12. The edges 12 are folded such that all cut edges of the non-woven material are double-folded under so as not to be exposed. Non-exposure of the edges 12 thus greatly reduces the potential for generation of shed particles where the material was cut. The seams 16 are stitched with an optimization of the number of stitches per inch (SPI), increased to 8-12 SPI over the standard 6-8 SPI. Stitch densities of 8-12 SPI have been found to be better than the lower range, as densities greater than 12 SPI weaken the non-woven material via excessive perforation and those less than 8 SPI provide a looser and weaker hem, such that particulate shedding is not minimized.

Figure 3:
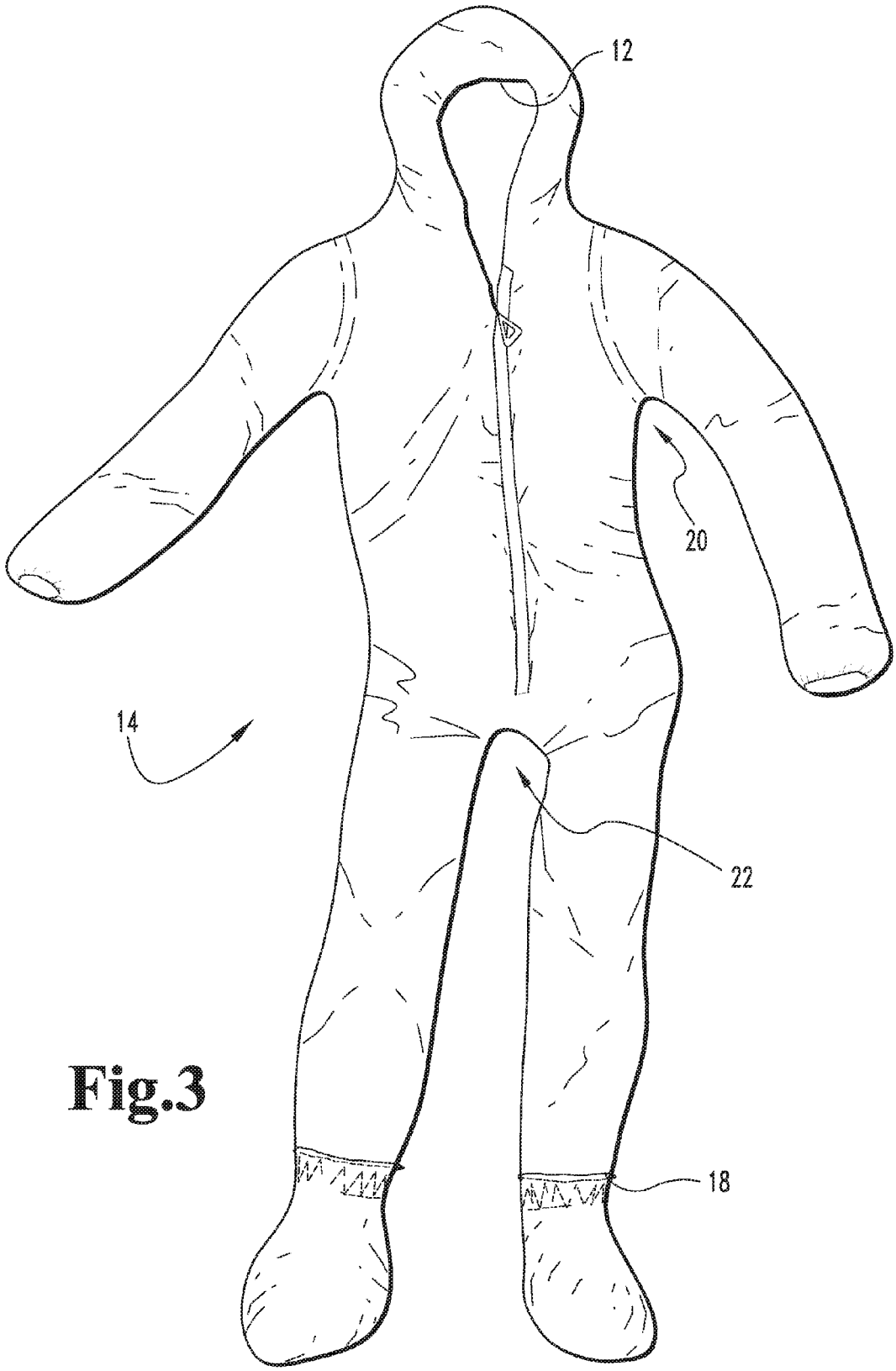
FIG. 3 is a perspective view of a safety garment in a second embodiment of the disclosed technology.

FIG. 3 illustrates a second embodiment of the present invention, a jumpsuit 14 made from spunbond/melt blown/melt blown/spunbond (SMMS) material, spunbond/melt blown/spunbond (SMS) material, or the like. The jumpsuit 14 includes twice-folded and hemmed edges 12. As in the first embodiment, the edges 12 are folded such that all cut edges of the non-woven material are double-folded under so as not to be exposed. The seams 16 in this embodiment are stitched with an increased stitch density of 8-12 SPI over the standard 6-8 SPI. Seams are also bound with additional welting or other integrative material to reinforce the seams against contamination. The garment also includes foot coverings 18 that are preferably stitched to the garment but may alternately be individually formed and attached, such as by an elastic band stitched into the hem at the foot opening. The garment 14 further includes an excess of material in the armpit 20 and groin/seat area 22, to minimize the risk of accidental tearing that might generate additional particulate matter that enters into the environment, and might expose the wearer to environmental hazards.

In practice, the garments 10 and 14 are often made by cutting one or more sheets of nonwoven material into a desired safety garment pattern. Simple patterns (e.g., shoe coverings) may require a single sheet; more complex patterns (e.g., smocks, jumpsuits, and the like) may require two or more sheets of varying size. The sheet(s) is/are then stitched together to define a garment 10. The edges of the garment 10 are then hemmed. All cut edges are twice folded and hemmed under to prevent exposure of any cut edges that could increase the likelihood of particulate shedding. All stitching in these illustrative embodiments is characterized by a stitch density in the range of 8 to 12 stitches per inch.

Figure 4:
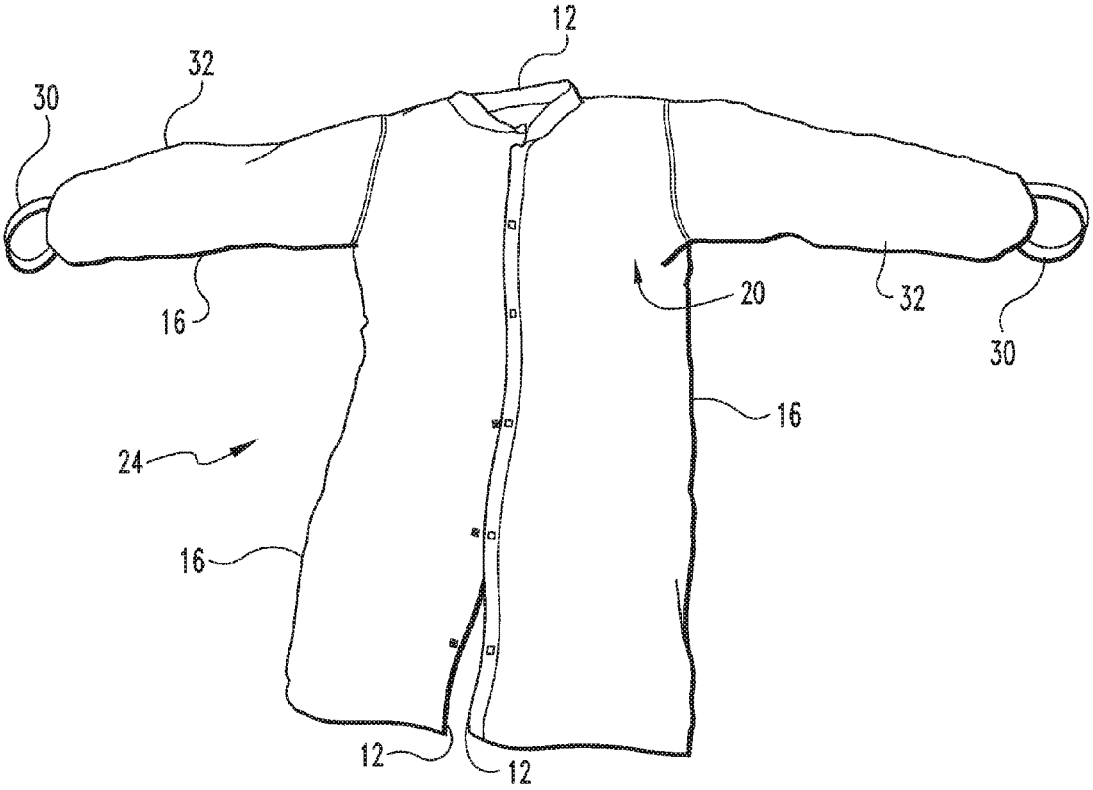
FIG. 4 is a perspective view of a safety garment in a third embodiment of the disclosed technology.

FIG. 4 illustrates a third embodiment garment 24. The garment 24 of FIG. 4 is similar to that described in FIG. 1, but with the addition of loops 30 affixed to the sleeve 32 portion of the garment 24, to engage a wearer's hands so as to keep the garment 24 positioned about the wearer's body. In this embodiment, as in the foregoing embodiment of FIG. 1, the safety garment 24 is formed as a smock and is preferably made from spunbond/melt blown/melt blown/spunbond (SMMS) material, spunbond/melt blown/spunbond (SMS) material, or the like. The garment 10 includes double-folded and hemmed edges 12. The edges 12 are folded such that all cut edges of the non-woven material are double-folded under so as to not be exposed. Non-exposure of the edges 12 thus greatly reduces the potential for generation of shed particles where the material was cut. The loops 30 are likewise folded over and stitched such that there are no exposed cut edges. The seams 16 are stitched with an optimization of the number of stitches per inch (SPI), increased to 8-12 SPI over the standard 6-8 SPI.

Figure 5:
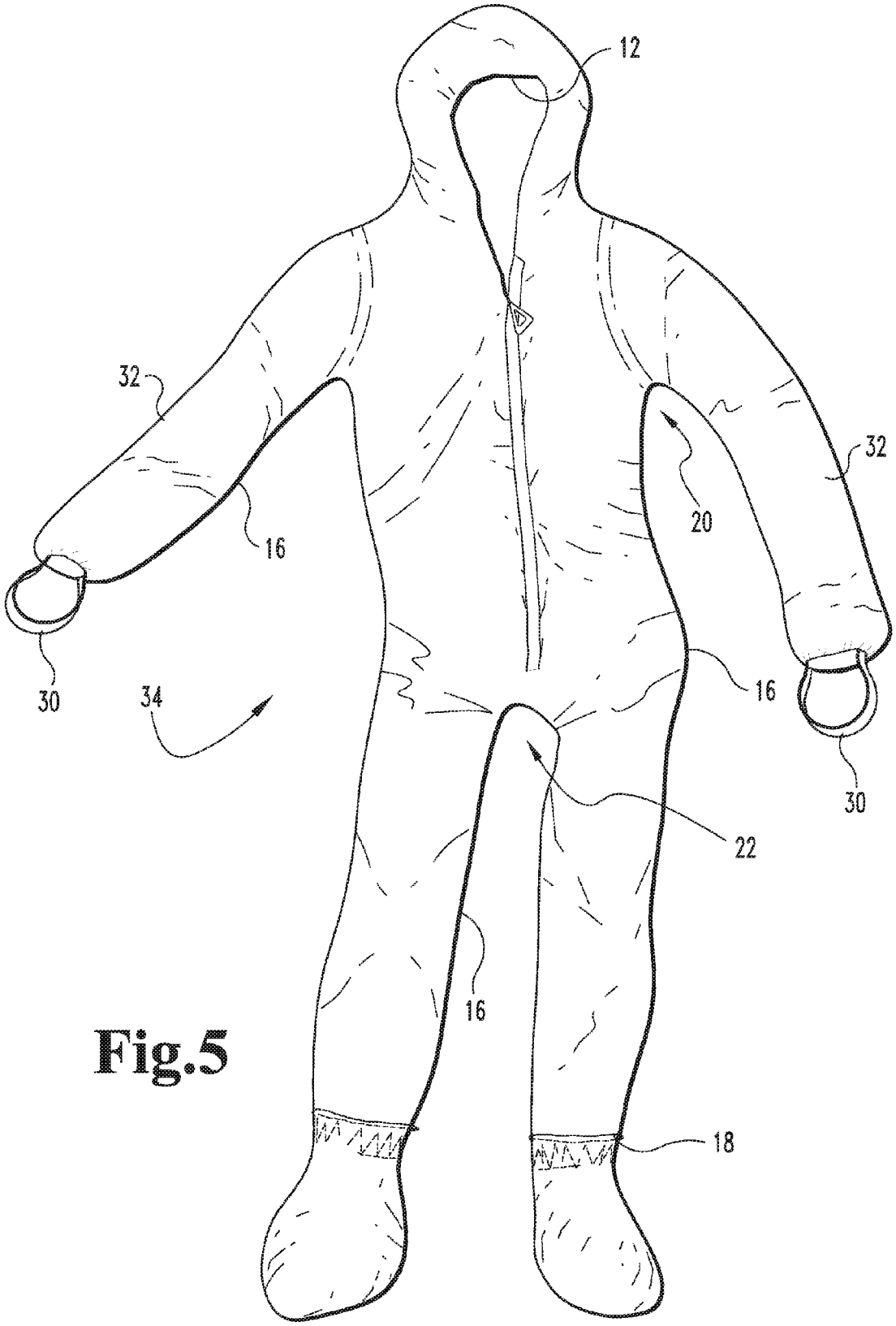
FIG. 5 is a perspective view of a safety garment in a fourth embodiment of the disclosed technology.

FIG. 5 illustrates a fourth embodiment, a jumpsuit 34 similar to that of FIG. 3 with the addition of loops 30 extending from the sleeve portion 32 of the garment 34 to engage the hands of a wearer (similar to the embodiment of FIG. 4). The jumpsuit 34 is likewise preferably made from spunbond/melt blown/melt blown/spunbond (SMMS) material, spunbond/melt blown/spunbond (SMS) material, or the like. The jumpsuit 34 includes twice-folded and hemmed edges 12. As in the first embodiment, the edges 12 are folded such that all cut edges of the non-woven material are double-folded under so as to not be exposed. The loops 30 are likewise formed of the SMMS, SMS or the like and folded over and stitched such that the cut edges are not exposed. The seams 16 are stitched with 8-12 SPI. The garment also includes foot coverings 18 that are preferably stitched to the garment, but may alternately be individually formed and attached, such as by an elastic band stitched into the hem at the foot opening. The garment 12 further includes an excess of material in the armpit 20 and groin/seat area 22, to minimize the risk of accidental tearing that might generate additional particulate matter into the environment as well as expose the wearer to environmental hazards.

The loops of the embodiments of FIGS. 4 and 5 are preferably formed with no exposed cut edges 12. In particular, each loop 30 is preferably formed from an elongated piece of cut nonwoven fabric defining a pair of generally parallel cut edges 12, and wherein the cut edges 12 are folded under and hemmed into place such that the cut edges 12 are not exposed.

Figure 6:
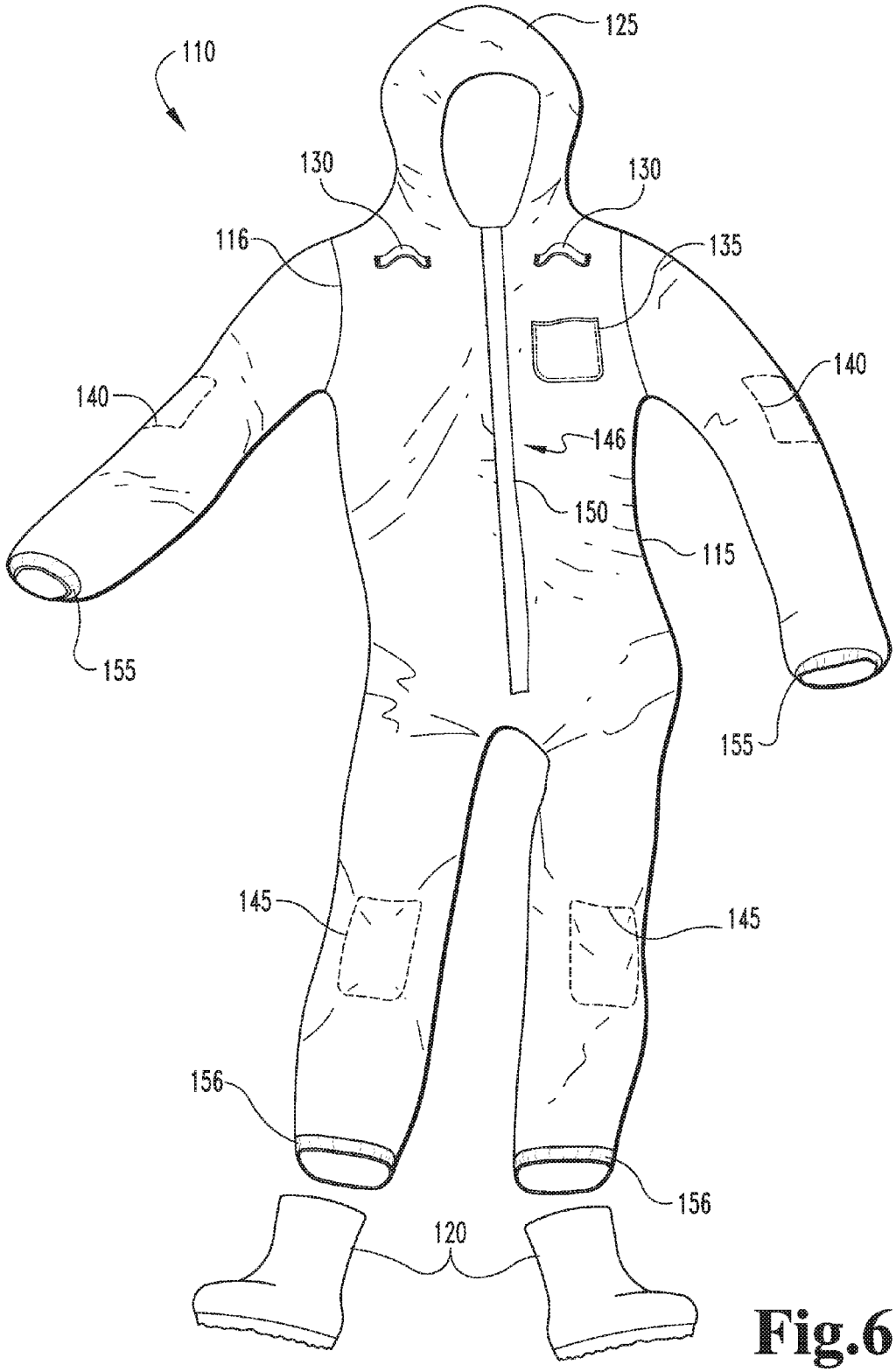
FIG. 6 shows a protective garment according to a fifth embodiment of the disclosed technology.

FIG. 6 illustrates a protective garment 110 for use with a radiation monitoring device according to one embodiment of the disclosed technology. In this particular embodiment, the garment 110 is a jumpsuit or coverall-type garment having a hood portion 125 and a body portion 115. This particular embodiment also includes separate boots 120, although other embodiments include separable or integrated foot coverings. Still other embodiments include separate, separable or integrated hand coverings. Yet other embodiments include separate, separable, or integrated hoods. The arm openings 155 and the leg openings 156 in this particular embodiment are hemmed so as to reduce shredding of the garment material. Optionally, the edges at arm openings 155 and the leg openings 156 are double-folded and hemmed such that all cut edges are double-folded under so as to not be exposed. Non-exposure of the edges greatly reduces the potential for generation of shed particles where the material was cut. In other embodiments, the arm openings 155 and/or leg openings 56 further include elastic bands so as to ensure a tight fit.

Figure 8:
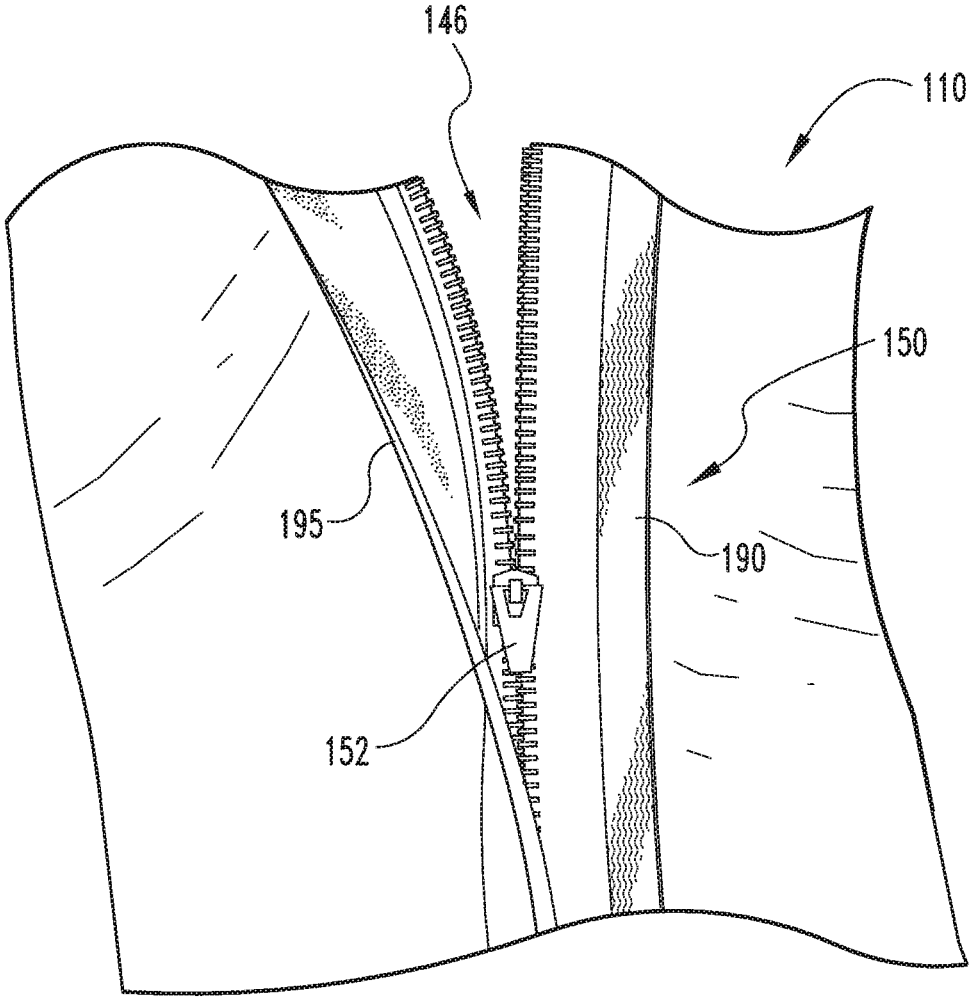
FIG. 8 shows a closure mechanism used in the fifth embodiment.

Garment 110 is accessible through opening 146, which is held closed using a closure means 150 shown in greater detail in FIG. 8. In this particular example, closure means 150 includes a zipper 152. In other examples, closure means 150 includes snaps, buttons, hook-and-loop closure materials such as Velcro®, adhesive strips, or any other suitable closure means. Additionally, closure means 150 further includes a cover flap 195 capable of being folded over once opening 146 is closed using zipper 152. Cover flap 195 prevents material from entering garment 110 through zipper 152. Flap 195 is releasably held in the closed position by a securing strip 190, which may comprise hook-and-loop closure materials such as Velcro®, adhesive strips, or any other suitable securing means.

Garment 110 can be made from a non-woven material such as polypropylene, polyethylene, polyester materials, and the like, including combinations of two or more non-woven materials. Such materials may be manufactured using spunbond/melt blown/melt blown/spunbond (SMMS) techniques, spunbond/melt blown/spunbond (SMS) techniques, flash spinning processes, or other suitable techniques for manufacturing non-woven garments, and may include two or more layers of material and/or multiple layers of different materials, as desired. The seams 116 located at various points about the garment 110 are optionally double-folded under so as not to be exposed. The seams 116 are also stitched with an optimized number of stitches per inch (SPI) increased to 8-12 SPI over 6-8 SPI, which is the industry standard. A stitch density of 8-12 SPI has been found to be optimal, as more than 12 SPI weakens the non-woven material via excessive perforation and less than 8 SPI provides a looser and weaker hem, such that particulate shedding is not minimized. Optionally, seams 16 are formed using some other method such as sonic welding or binding with welting or other materials.

Continuing with the embodiment shown in FIG. 6, garment 110 further includes at least one attachment feature 130 for a dosimeter or other measurement, communication, or detection device. In this particular example, garment 110 includes two attachment features 130 located near the garment shoulders on its front side. Other embodiments include a greater or lesser number of attachment features positioned at other locations about the garment, such as the arms, wrists, or waist area, as desired. Attachment features 130 are shown as loops or straps affixed to garment 110 using box-type stitches. In other examples, attachment features 130 have a different configuration such as a sleeve, pouch, pocket, or the like, and are attached using a different type of stitching or a different attachment means such as adhesives, snaps, ties, and the like. Optionally, garment 110 includes further monitoring and/or communication devices in addition to dosimeters, such as body temperature monitoring devices, radios, pulse rate monitors, and the like.

In one embodiment of the disclosed technology, garment 110 is constructed such that one or more closures (zippers, adhesives, etc.) are designed to open, rip, or tear when a force above a predetermined threshold is applied. Such "tear-open" garments are designed so as to allow for easy removal of a garment when it is no longer needed. Tear-open garments allow workers to quickly, safely, and easily remove a garment upon, for example, the end of a shift.

Attachment features 130 are optionally positioned about the garment so as to allow a wearer to grasp one or more of them, and of sufficient strength such that pulling on the attachment features 130 causes the tear-open closures 150 to at least begin to open, thereby allowing the worker to quickly, safely, and easily remove the garment 110. Alternatively, garment 110 according to another embodiment of the disclosed technology will open at the closure means 150 when sufficient force is applied by the wearer to the attachment features 130 to such an extent so as to allow the wearer to remove the garment 110 in its entirety.

Portions of garment 110 likely to experience wear such as the knees and elbows may include reinforced portions 140, 145 to preclude seepage or bleed-through of contamination in the event the wearer leans or kneels in contaminated environments. Reinforced portions 140, 145 may be made from the same material as garment 110, or from a different, stronger material. Optionally, garment 110 may be made from two or more layers of material. Reinforced portions 140, 145 may be attached to the interior or exterior surface of garment 110 and may be attached using adhesives, stitching, or any other suitable attachment method. Garment 110 may also include one or more pockets 135 located about the garment as desired.

Figure 7:
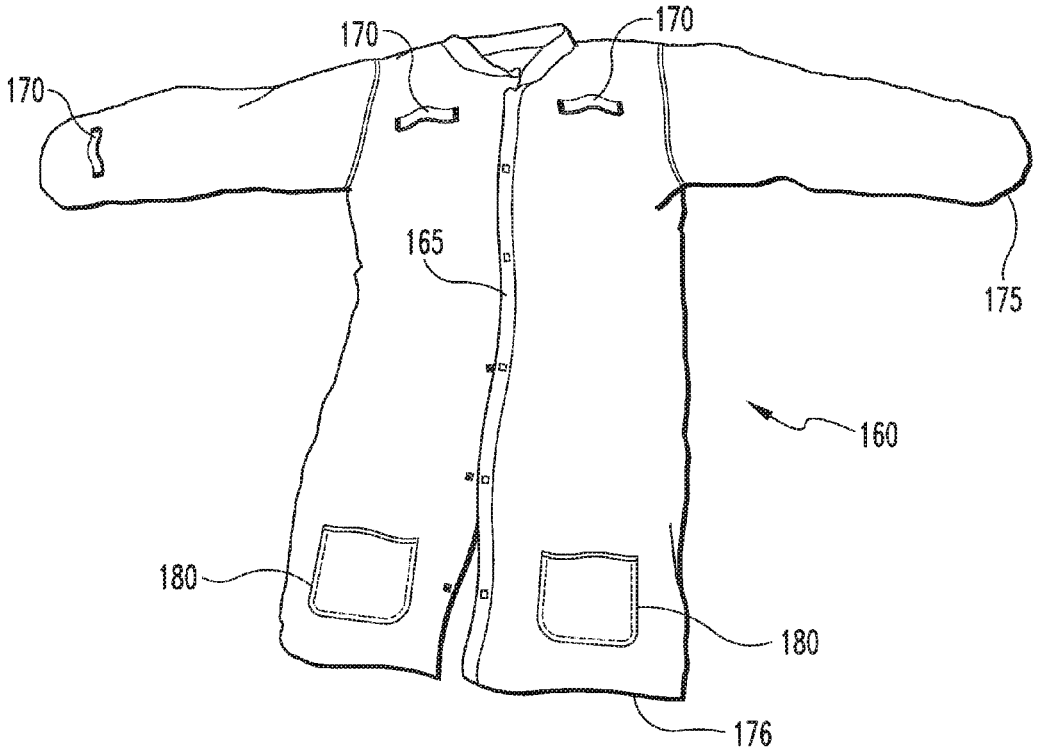
FIG. 7 shows a protective garment according to a sixth embodiment of the disclosed technology.

FIG. 7 shows an alternative embodiment of a garment 160. Garment 160 is a smock or apron having two sleeves 175 and an open bottom or lower portion 176 that extends down about the wearer's torso. Garment 160 is closed using a closure means 165 (shown in this particular example as a plurality of snaps). In other examples, closure means 165 may take the form of a zipper, buttons, adhesive strips, or any other suitable closure means. Garment 160 further includes two pockets 180 located near bottom portion 176, although other embodiments may include more or fewer pockets located at different points about garment 160.

Continuing with the embodiment shown in FIG. 7, garment 160 further includes at least one attachment feature 170. In this particular example, garment 160 includes two attachment features 170 located near the garment shoulders and one attachment feature 170 located on a sleeve. Other embodiments include a greater or lesser number of attachment features positioned at other locations on the garment such as the arms, wrists, or waist area as desired. Attachment features 170 are shown as loops or straps affixed to garment 160 using box-type stitches. In other examples, attachment features 170 have a different configuration such as a sleeve, pouch, pocket, or the like, and are attached using a different type of stitching or a different attachment means such as adhesives, snaps, ties, and the like. Optionally, garment 160 includes further monitoring and/or communication devices in addition to dosimeters such as body temperature monitoring devices, radios, pulse rate monitors, and the like.

Figure 9:
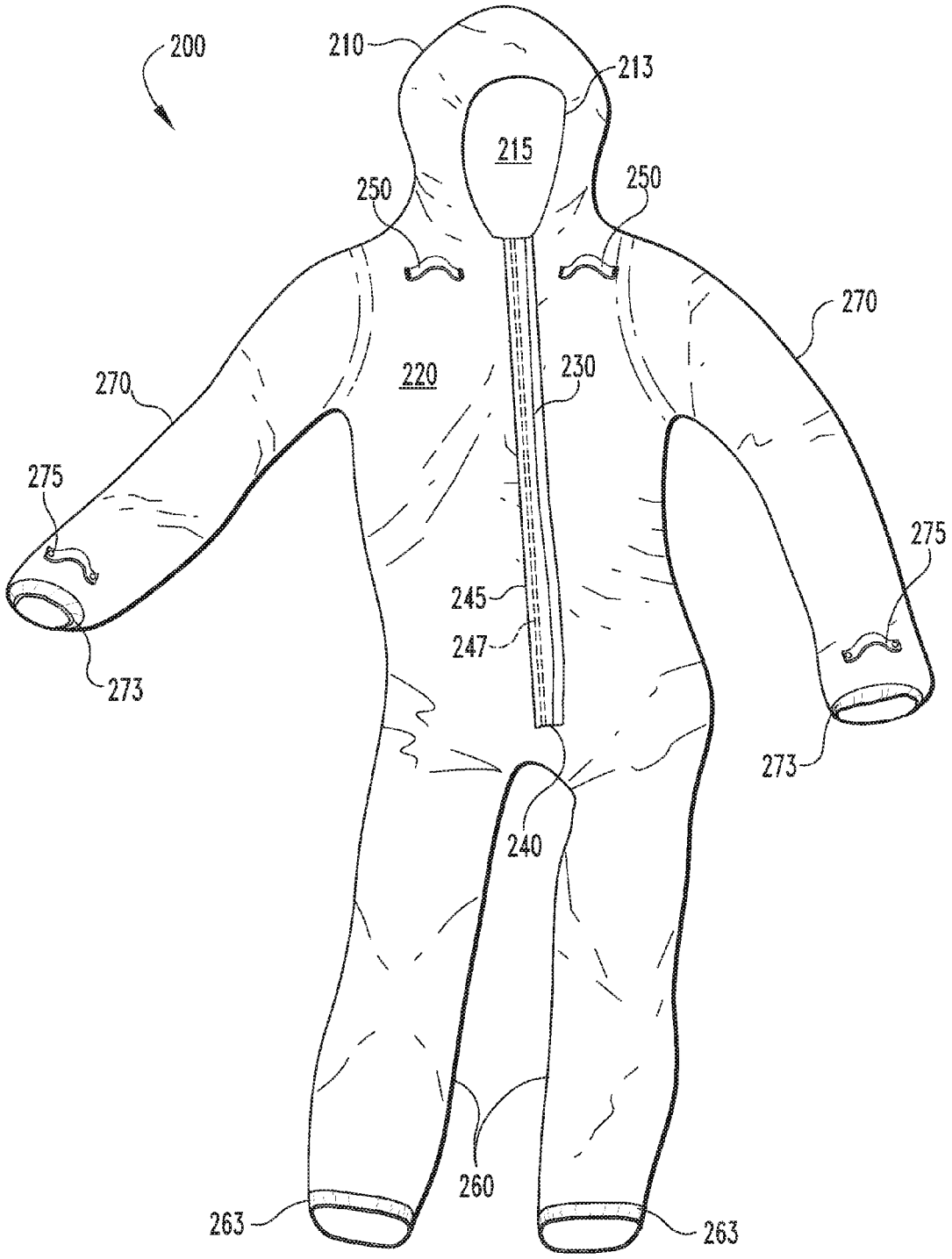
FIG. 9 shows a protective garment according to a seventh embodiment of the disclosed technology.

Turning to the embodiment shown in FIG. 9, a garment 200 generally has a hood that closes snugly around a full face respirator or air mask, thereby reducing the necessity for additional tape or material for covering the neck, and reducing the risk of breach of the integrity of the seal around the neck area from external radiological, environmental or other contaminants. Garment 200 further comprises an improved hood and closure system. In this garment 200, hood 210 is either made of contiguous nonwoven fabric with body 220 or, as a separate element formed from one or more cut panels of the same or different nonwoven fabrics stitched to body 220. (Other assembly techniques will occur to those skilled in the art.) Hood 210 and body 220 include an opening at the front of the suit 200 that is shown closed by zipper 230 or other closure device. In some embodiments, including for example the embodiment shown in FIG. 8, zipper 230 is covered by flap 240 over all or part of its length.

The loose edge 245 of flap 240 in some embodiments is secured to body 220 and hood 210 by a two-part closure device 247, which might be one-time-closable, reopen-able, and/or repositionable closure device. In some embodiments, two-part closure device 247 is adhesive-based, such as a peel-and-stick adhesive strip, where adhesive is on either the flap 240 or the body 220/hood 210, and the other (the body 220/hood 210 or the flap 240, respectively) includes a landing zone to which the adhesive adheres well. In other embodiments, two-part closure device 247 is a hook-and-loop closure, with a region of hook material on the flap 240 and a region of loop material on body 220/hood 210. Other alternative two-part closure devices include buttons, slide closures, snaps, adhesive tape strips, and the like.

In use, the wearer of suit 200 typically dons a respirator or air mask, then suit 200. After she puts her legs and arms in the legs 260 and arms 270 of suit 200, she puts the hood 210 over her head and closes zipper 230 up to the edge 213 of face opening 215. She then closes flap 240, securing flap 240 to the hood 210 and body 220 using two-part closure device 247. In the illustrated embodiment shown in FIG. 9, extra fabric is provided around the neck area and under the chin relative to other embodiments and suits, in combination with elastic embedded in the hood edge 213, in order to allow the edge 213 of the hood 210 to fully surround the perimeter of the respirator without the need to seal the edge 213 to the respirator by mechanical or adhesive means (i.e. tape) to produce an occlusive seal. In other embodiments, tape or other means are used to further secure edge 213 to the mask or respirator. In some embodiments, there is elastic around edge 213 that has a stretched (vertical), or open, diameter and a contracted, or closed, diameter that fits around a face mask or respirator. In some embodiments, the open diameter of face opening 215 is less than about 15 inches. In preferred embodiments, the open diameter is less than about 10 inches, while in more preferred embodiments, the closed diameter is less than about 7 inches.

In use, in order to remove garment 200, the wearer opens at least the top of two-part closure device 247 and pulls removal features, in this embodiment, doffing loops 250. In some embodiments, this begins to open zipper 230, and the wearer opens it the rest of the way, while in other embodiments zipper 230 is manually opened without the assistance of doffing loops 250. In some embodiments, the wearer pulls on a doffing loop 275 to remove her arm from each sleeve, including pulling her hand through the elastic band 273 at each wrist. The wearer preferably removes all of garment 200 using the "inside-out" method, containing all "outside" surfaces of the garment 200 that had been exposed to actual or potential contamination within the inside-out garment 200 and disposing of it appropriately.

Figure 10:
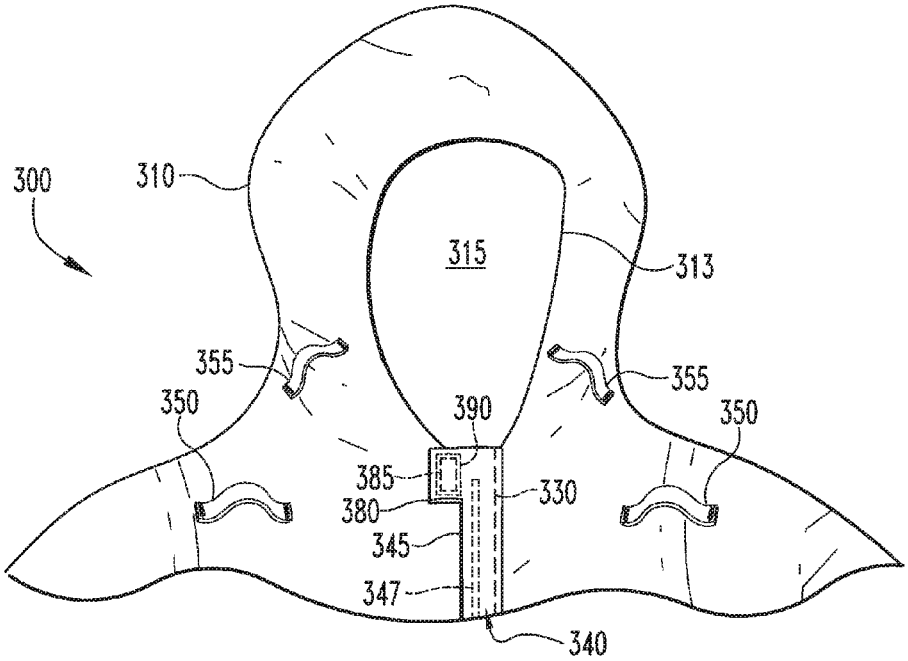
FIG. 10 shows an alternative design for the hood and upper body portions of the garment of FIG. 9.

In yet another embodiment, the neck flap is extended and includes an extra closure device, while the hood bears additional doffing loops 355 as illustrated in FIG. 10 as garment 300. Garment 300 includes zipper 330, flap 340, two-part closure strip 347 that holds loose edge 345 close to the body, and doffing loops 350 on either side of the chest near the shoulders, all as discussed in corresponding terms above. Garment 300 also includes an extra portion 380 of flap 340 adjacent to or near the bottom of face opening 315 along hood edge 313. On the body side of extra portion 380 is a patch of hook fabric 385 that mates with target zone 390, which is a patch of loop fabric that holds extra portion 380 in a closed position, but allows the extra portion 380 of flap 340 to be reopened when desired. In alternative embodiments, different two-part closure devices are used with one part on the back of extra portion 380 in the other on the front portion of the bottom of hood 310. Doffing loops 355 on either side of hood 310 give the user additional grasping points for removing the hood 310 and opening the top of zipper 330 while keeping (potentially) contaminated gloves away from the exposed neck.

Figure 11:
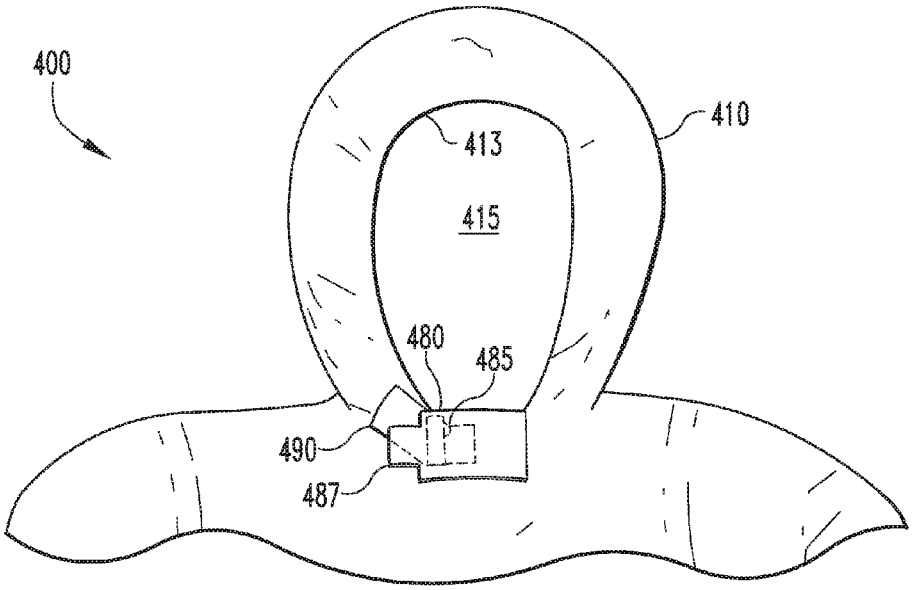
FIG. 11 shows another alternative design for the hood and upper body portions of the garment of FIG. 9.

In still another embodiment, shown in FIG. 11 as garment 400, flap 480 has a grasping tab 487 that extends beyond two-part closure device portion 485 to provide an unattached point at which the wearer can grasp the flap 480 and pull it open to begin doffing the garment 400. In alternative embodiments, grasping tab 487 takes the form of a strap, cord, or "tail" of any of a variety of shapes and materials, as will occur to those skilled in the art in view of the present disclosure. On garment 400, closure device portion 485 mates with landing area 490, as discussed above in relation to garment 300 and FIG. 10. On garment 400, however, landing area 490 is vertically wide enough and extends far enough around edge 413 of face opening 415 to make face opening 415 adjustable for different-sized masks, respirators, and other equipment. The adjustment of this sizing is facilitated in this embodiment by the re-positionable character of two-part closure device 485/490.

Figure 12:
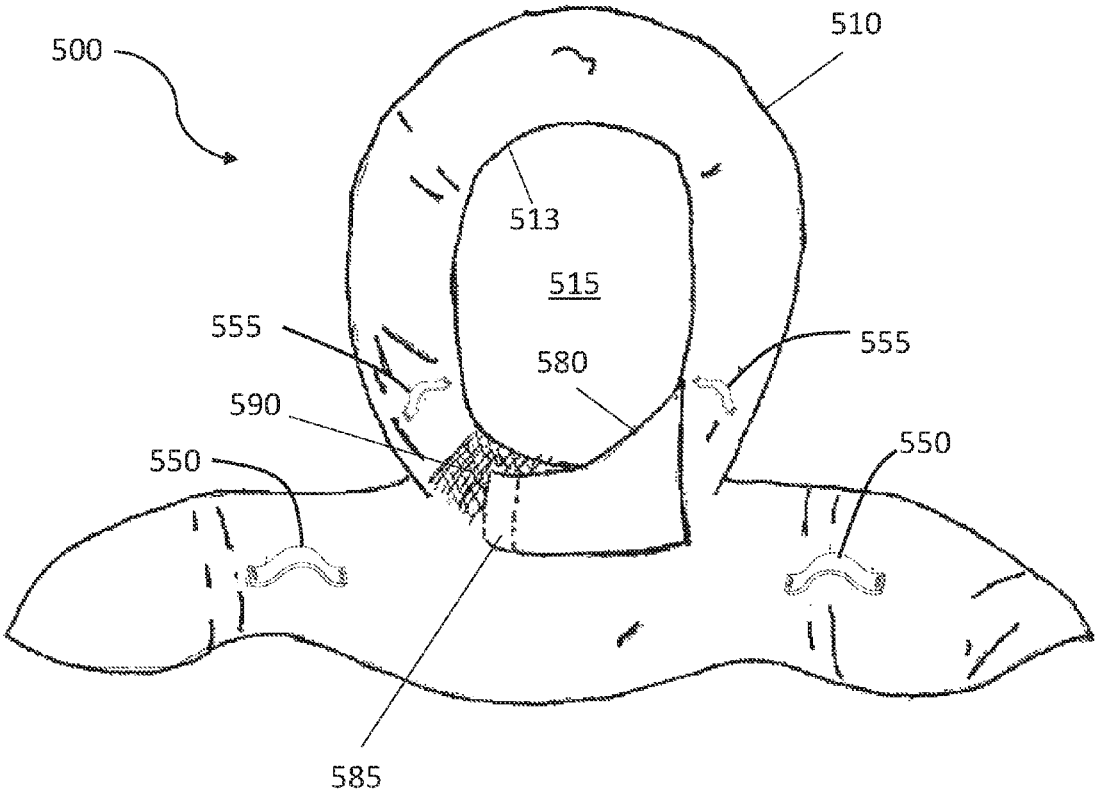
FIG. 12 shows a further alternative design for the hood and upper body portions of the garment of FIG. 9.

In even yet a further embodiment, shown in FIG. 12 as garment 500, closure device portion 585 mates with landing area 590, as discussed above in relation to garments 300 and 400. Similar to garment 400, landing area 590 on garment 500 is vertically wide enough and extends far enough around the edge 513 of face opening 515 to make face opening 515 adjustable for different-sized masks, respirators, and other equipment. The adjustment of this sizing is facilitated in this embodiment by the re-positionable character of two-part closure device 585/590. In the embodiment shown in FIG. 12, at least a portion of the flap 580 is constructed from a stretch non-woven material. In some embodiments, substantially all of the flap 580 is constructed from a stretch non-woven material. In preferred embodiments, the stretch non-woven material has multi-directional stretching characteristics.

Similar to garment 200, there is elastic around edge 513 of garment 500 that has a stretched (vertical), or open, diameter and a contracted, or closed, diameter that fits around a face mask or respirator. In this embodiment, flap 580 is constructed from a stretch non-woven material of sufficient size such that, when mated to landing area 590, flap 580 closes snuggly around a respirator or supplied air mask worn by the user, thereby covering the gap typically existing between a safety garment and respirator or supplied air mask beneath the wearer's chin. The stretchable nature of the stretch non-woven material allows the flap 580 and hood to 510 conform to the shape of the respirator or supplied air mask and eliminates the need for utilizing tape in order to cover or close the gap. In some embodiments, as shown in FIG. 12, the portion of flap 580 adjacent to face opening 515 is substantially concave in shape in order to correspond to the substantially convex shape of the lower portions of typical respirators and air masks.

Similar to garment 300, garment 500 includes doffing loops 350 on either side of the chest near the shoulders and doffing loops 555 on either side of hood 510, all as discussed in corresponding terms above.

In some embodiments, the garment covers substantially all of the wearer. In other embodiments, the garment covers substantially all of the wearer above the waist. In further embodiments, the garment covers substantially all of the head, shoulders, and upper torso of the wearer.

It will be understood by those skilled in the art that the features of each illustrated embodiment can be mixed and matched, tweaked and adapted as needed or desired. Particular embodiments may or may not include, for example, features corresponding to double-folded and hemmed edges or bound seam 12; stitch density of 8-12 SPI; hand-engaging loops 30; integrated hand or foot coverings; reinforced elbows and knees; attachment features 130; tear-away seams; zipper 230; doffing loops 250, 275, 355, or 555; two-part closure devices 247, 385/390, 485/490, or 585/590; limited or broad landing areas 390, 490, or 590; elastic cuffs 263, 273; and grasping tab 487. The flap that covers the neck may be short as illustrated on garment 400, or may be long as illustrated in garment 200. The flap that cover the neck may also comprise a relatively small portion of the hood edge, as illustrated in garments 200 and 300, or may comprise a relatively large portion of the hood edge, as illustrated in garment 500. The removal features have been described primarily as doffing loops, however, straps, handles, cords, strings or other grippable structures may be used as removal features instead of or in conjunction with doffing loops.

While the disclosed technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is also understood that one of ordinary skill in the art could readily make a near infinite number of insubstantial changes and modifications to the above-described embodiments, and that it would be impractical to attempt to describe all such variations in the present specification. Accordingly, it is understood that all changes and modifications that come within the spirit of the disclosed technology are desired to be protected.

What is claimed is:

1. A nonwoven safety garment for protecting against radiological, light splash, or biological hazards, comprising:

a garment having an inside and an outside and covering substantially all of the wearer;

an integrated hood including an edge that defines a face opening;

a closure that openably closes the garment, a first end of said closure being disposed adjacent the hood face opening;

a neck flap attached to a first side of the face opening of said hood, the neck flap bearing one part of a two-part attachment device, the second part of the two-part attachment device being disposed on a second side of the face opening opposite the first side of said hood, wherein the neck flap defines the bottom of the face opening and inhibits the closure from opening when the first part and the second part of the two-part attachment device are in contact, the neck flap including a grasping tab portion disposed two-part adjacent the attachment device, the grasping tab portion defining a portion for the user to grasp and open the neck closure; and two or more doffing loops positioned and attached to the outside of the garment with sufficient strength such that a wearer can pull on one or more of the doffing loops to doff at least a portion of the garment, each doffing loop attached to the outside of the garment and forming a portion through which a user may insert a digit to grasp the doffing loop, one of said two or more doffing loops being attached to the integrated hood, another of said two or more doffing loops being attached to a chest area of the garment adjacent to the first end of the closure;

wherein movement of the neck flap away from the second side of the face opening by a user and movement of the doffing loop attached to the integrated hood away from the chin of the user opens the closure while permitting the user's hands to remain away from the neck of the user in order to avoid contact;

wherein movement of the doffing loop attached to the chest area of the garment away from the closure further opens the closure; and wherein at least a portion of the neck flap is constructed from a stretch non-woven material.

2. The nonwoven safety garment as in claim 1, further comprising:

at least one or more additional doffing loops being attached to the integrated hood, the first of said hood doffing loops being disposed adjacent the face opening of said hood, while the second of said hood doffing loops being disposed adjacent the face opening on the opposing side of the face opening from the first hood doffing loop, and wherein movement of the first and second hood doffing loops away from one another further opens the closure.

3. The nonwoven safety garment as in claim 1, comprising:

at least one or more additional doffing loops being attached to the chest area of the garment adjacent to the first and of said closure, the first of said chest doffing loops being disposed on a first chest area, while the second of said chest doffing loops being disposed on a second chest area on the opposing side of the closure than the first chest doffing loop, and wherein movement of the first and second chest doffing loops in opposing directions further opens the closure.

4. The nonwoven safety garment as in claim 1, wherein the stretch non-woven material from which a portion of the neck flap has multi-directional stretching characteristics.

5. A nonwoven disposable safety garment for protecting against radiological, light splash, or biological hazards, comprising:

a garment having an interior and an exterior covering substantially all of the wearer;

an integrated hood including an edge that defines a face opening;

a closure that openably closes the garment, a first end of the closure being disposed adjacent the hood face opening;

a neck flap attached to a first side of the face opening, the neck flap bearing one part of a two-part attachment device, the second part of said two-part attachment device being on a second side of the face opening opposite the first side, wherein the neck flap defines the bottom of the face opening and inhibits the closure from opening when the first part and the second part of the two-part attachment device are in contact; and one or more removal features positioned and attached to the exterior of the garment, each said removal features having sufficient strength such that a wearer can pull on one or more of the removal features to doff at least a portion of the garment, each said removal feature being attached to the exterior of the garment;

wherein movement of the neck flap away from the second side of the face opening by the wearer and movement of one or more of the removal features by the wearer opens the closure while avoiding the wearer's hands from contacting his or her neck; and wherein at least a portion of the neck flap is constructed from a non-woven fabric.

6. The garment of claim 5, wherein the garment covers substantially all of the wearer.

7. The garment of claim 5, wherein the one or more removal features include two removal features being attached to a chest area of the garment adjacent to the first end of the closure on opposing sides of the enclosure, and wherein movement of the chest removal features away from each other further opens the closure.

8. The garment of claim 7, wherein movement of the neck flap away from the second side of the face opening, movement of the removal features attached to the integrated hood away from one another, and movement of the removal features attached to the chest area of the garment away from one another fully open the closure without a user's hands contacting the inside of the garment.

9. The garment of claim 5, wherein the one or more removal features include two removal features being attached to the integrated hood with each being disposed on opposing sides of the hood face opening.

10. The garment of claim 5, wherein the one or more removal features include two removal features being attached to a chest area of the garment and two removal features being attached to the integrated hood.

11. The garment of claim 5, wherein the neck flap includes a grasping tab portion, the grasping tab portion defining a portion for the user to grasp and open the neck closure.

12. The garment of claim 5, wherein a portion of the hood adjacent the face opening is constructed from a multi-dimensional stretch non-woven material.

13. A method of making a safety garment for protecting against radiological, light splash, or biological hazards, comprising the acts of:

connecting portions of at least one sheet of nonwoven material to define a garment that has an interior and an exterior, covers substantially all of a wearer, an integrated hood that defines a face opening, and a closure that openably closes the garment to permit entry and exit by the wearer, a first end of said closure being disposed adjacent to the hood face opening;

forming a neck flap extending from a first side of the face opening, the neck flap bearing one part of a two-part attachment device, the second part of the two-part attachment device being disposed on a second side of the face opening opposite the first side, wherein the neck flap defines the bottom of the face opening and inhibits the closure from opening when the first part and the second part of the two-part attachment device are in contact, and wherein at least a portion of the neck flap is constructed from a stretch non-woven material; and attaching one or more removal features to the exterior of the garment with sufficient strength such that the wearer can pull on one or more of the removal features to doff at least a portion of the garment, each removal feature including a portion that may be grasped by a user, wherein the removal features and the neck flap are positioned to allow a user to open the closure by pulling on the neck flap, one or more removal features, or the neck flap and one or more removal features, while keeping the wearer's hands from coming into contact with the head, neck or body of the wearer or the interior of the garment.

14. The method of claim 13, wherein a portion of the hood adjacent the face opening is constructed from a multi-dimensional stretch non-woven material.

15. The method of claim 13, wherein the neck flap includes a grasping tab portion, the grasping tab portion defining a portion for the user to grasp and open the neck closure.

16. The method of claim 13, wherein at least one removal feature is a doffing loop.

17. The method of claim 13, wherein the one or more removal feature is attached to at least one of the integrated hood and a chest area of the garment adjacent the first end of the closure.

18. A method of removing a nonwoven safety garment for radiological, light splash, or biological hazard protection, comprising the acts of:

grasping and pulling a neck flap attached to a first side of an integrated hood and defining a face opening, the neck flap bearing one part of a two-part attachment device, the second part of the attachment device being on a second side of the face opening opposite the first side, the neck flap defining the bottom of the face opening;

initially opening a garment closure through which a user dons the garment, a first end of the closure being adjacent to the face opening, said initially opening resulting from grasping and pulling two first removal features attached to the exterior of the integrated hood.

19. The method of claim 18, further comprising:

further opening the garment closure to an extent greater than that achieved by said initially opening, said further opening resulting from grasping and pulling two second removal features attached to the chest area of the garment adjacent to the first end of the closure.

20. The method of claim 18, wherein at least a portion of the neck flap is constructed from a multi-dimensional stretch non-woven material.

* * * * *